US012778309B2

(12) United States Patent
Di Mario

(10) Patent No.: US 12,778,309 B2
(45) Date of Patent: Nov. 3, 2026

(54) ACTIVE SUSPENSION

(71) Applicant: GELLI PLAST S.R.L., Monteriggioni (IT)

(72) Inventor: Giuseppe Di Mario, Tredozio (IT)

(73) Assignee: GELLI PLAST S.R.L., Monteriggioni (IT)

( * ) Notice: Subject to any disclaimer, the term of this patent is extended or adjusted under 35 U.S.C. 154(b) by 3 days.

(21) Appl. No.: 18/867,319

(22) PCT Filed: Mar. 31, 2023

(86) PCT No.: PCT/IB2023/053243
§ 371 (c)(1),
(2) Date: Nov. 19, 2024

(87) PCT Pub. No.: WO2023/223107
PCT Pub. Date: Nov. 23, 2023

(65) Prior Publication Data

US 2025/0213049 A1 Jul. 3, 2025

(30) Foreign Application Priority Data

May 20, 2022 (IT) ..... 202022000002057

(51) Int. Cl.
*A47C 23/00* (2006.01)

(52) U.S. Cl.
CPC ..... *A47C 23/002* (2013.01)

(58) Field of Classification Search
CPC .... A47C 23/002; A47C 23/063; A47C 23/064
USPC ..... 5/1, 244, 245, 247
See application file for complete search history.

(56) References Cited

U.S. PATENT DOCUMENTS 62,653 A * 3/1867 Manuel ..... A47C 23/05 5/264.1
4,592,106 A * 6/1986 Hagemeister ..... A47C 23/002 24/652
4,752,981 A * 6/1988 Salens ..... A47C 23/064 5/191
5,052,063 A * 10/1991 Elmalek ..... A47C 23/064 5/241
5,787,533 A * 8/1998 Fromme ..... A47C 23/002 5/255
6,477,727 B1 * 11/2002 Fromme ..... A47C 23/002 5/255

(Continued)

FOREIGN PATENT DOCUMENTS

DE 202008010210 U1 10/2008
DE 102013106008 A1 12/2014
EP 1535541 A1 * 6/2005 ..... F16F 1/34

OTHER PUBLICATIONS

International Search Report dated Jul. 11, 2023 from counterpart PCT App No. PCT/IB2023/053243.

*Primary Examiner* — Myles A Throop
(74) *Attorney, Agent, or Firm* — SHUTTLEWORTH & INGERSOLL, PLC; Timothy J. Klima

(57) ABSTRACT

Described is an improved active suspension to give an additional spring to an overlying mattress, including an elastic element including a central body, a plurality of flexible arms extending in a cantilever fashion from the central body and a raised perimeter portion connected to the flexible arms and supported elastically by them, a member for supporting the elastic element, designed to be mounted on a slat.

5 Claims, 5 Drawing Sheets

(56) References Cited

U.S. PATENT DOCUMENTS

| | | | | |
|---|---|---|---|---|
| 6,826,791 | B2 * | 12/2004 | Fromme | A47C 23/002 5/255 |
| 6,983,497 | B2 * | 1/2006 | Lobry | A47C 23/068 5/236.1 |
| 7,069,606 | B2 * | 7/2006 | Verschuere | A47C 23/064 5/236.1 |
| 7,297,389 | B2 * | 11/2007 | Lobry | A47C 23/002 267/143 |
| 7,621,004 | B2 * | 11/2009 | Lobry | A47C 23/064 5/236.1 |
| 7,938,387 | B2 * | 5/2011 | Fossati | A47C 23/002 267/164 |
| 8,156,583 | B2 * | 4/2012 | Lobry | A47C 23/064 5/241 |
| 9,222,535 | B2 * | 12/2015 | Bock | F16F 1/36 |
| 10,334,956 | B2 * | 7/2019 | Lobry | A47C 21/06 |
| 10,413,080 | B2 * | 9/2019 | Bretis | A47C 27/065 |
| 2012/0066834 | A1 * | 3/2012 | Jansen | A47C 23/067 5/246 |

* cited by examiner

ACTIVE SUSPENSION

This application is the National Phase of International Application PCT/IB2023/053243 filed Mar. 31, 2023 which designated the U.S.

This application claims priority to Italian Patent Application No. 202022000002057 filed May 20, 2022, which application is incorporated by reference herein.

TECHNICAL FIELD

This invention relates to an improved active suspension.

In particular, the invention relates to an active suspension made of plastic material.

The improved active suspension device according to the invention is used in particular in the field of recreational vehicles and boats.

BACKGROUND ART

It is known that active suspensions are additional elements to be applied to the slats of the beds to give, to the overlying mattresses, suitable additional localised springs with which to personalise the use and make sleep more comfortable.

In recreational vehicles, such as camper vans, motorhomes or the like or also in boats, for reasons of practicality and dimensions the mattresses are not generally very thick, thereby often making sleeping on them not particularly comfortable.

Further, both on account of the humidity of the locations (in particular in boats) and the prolonged periods of non-use (for example in camper vans during the winter period), it is particularly opportune to provide an adequate aeration of the mattresses by detaching them from the supporting surface.

The active suspensions of known type are not always easily applicable to the slats for supporting the mattress and their positioning according to the physical characteristics or the particular postural needs of the user is not always easy to perform, also on account of the complex system for fixing to the slats, often with screws or the like.

AIM OF THE INVENTION

The aim of the invention is provide an active suspension which is able to overcome the drawbacks of the prior art and is at same time practical to use and inexpensive to make.

Another aim of the invention is to provide an active suspension that allows anyone, easily and without tools, to choose at any time the arrangement of the active suspensions and also how to subsequently modify it to adapt it to the changed needs of the first user or to different needs of the successor, if any.

In the context of this purpose, another aim of the invention is to allow the use of active suspensions also on the flat surfaces to be equipped as necessary for the most appropriate supporting of a mattress.

Yet another aim of the active suspension according to the invention is to limit costs both with shapes which facilitate the moulding with moplen or other suitable plastic material and by making the same active suspension usable, with different supports, both on the slats and on the flat surfaces.

According to the invention, these aims and others are achieved by an active suspension comprising the technical features described in the accompanying claims.

BRIEF DESCRIPTION OF THE DRAWINGS

The technical features of the invention, according to the above-mentioned aims, are clearly described in the appended claims and its advantages are apparent from the detailed description which follows, with reference to the accompanying drawings which illustrate non-limiting example embodiments of it, and in which:

DETAILED DESCRIPTION

Figure 1:
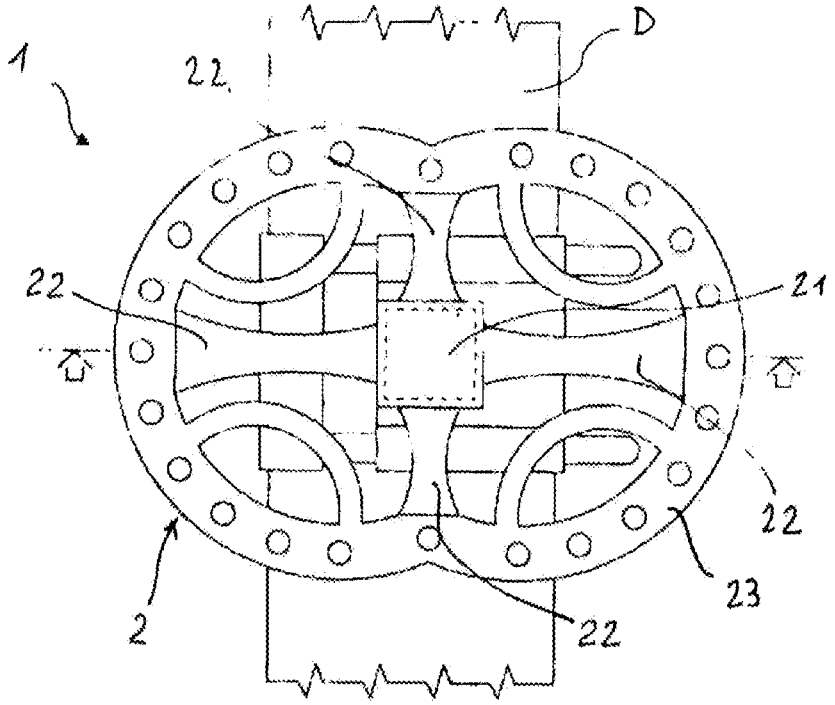
FIG. 1 is a schematic top plan view of a first embodiment of the active suspension according to the invention, already applied to a slat of a bed.

With reference to the accompanying drawings, the reference numeral 1 denotes in its entirety a first embodiment of the improved active suspension according to the invention.

The active suspension 1 is designed to give an additional spring to an overlying mattress, not illustrated.

Figure 2:
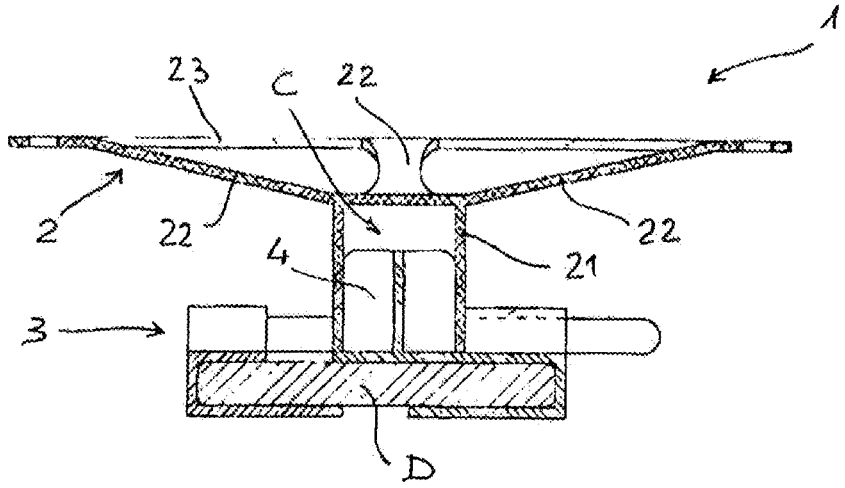
FIG. 2 is a cross section view of the active suspension of FIG. 1, according to a plane through the line II-II shown in FIG. 1.
Figure 3:
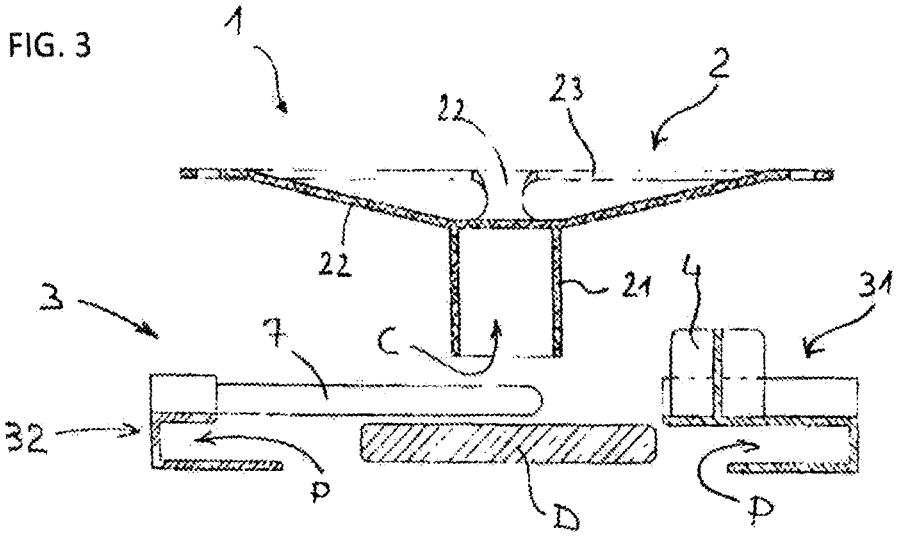
FIG. 3 illustrates the view of FIG. 2 in an exploded configuration.
Figure 7:
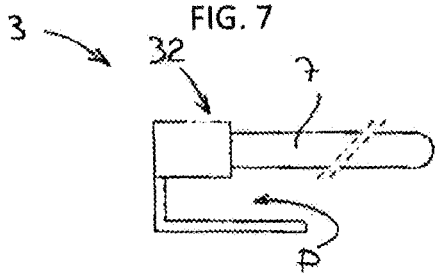
FIGS. 7 to 9 are three views from respective different angles of a second component of the suspension of FIG. 1.
Figure 4:
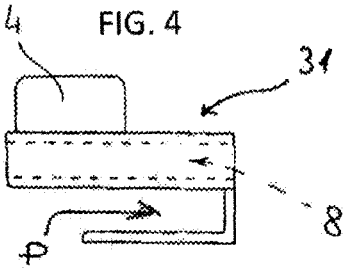
FIGS. 4 to 6 are three views from respective different angles of a first component of the suspension of FIG. 1.
Figure 9:
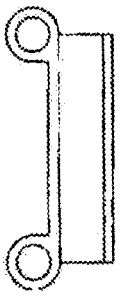

As illustrated in FIGS. 1 and 2, the active suspension 1 comprises an elastic element 2 and a member 3 for supporting the elastic element 2, the supporting member 3 being designed to be mounted on a slat D.

The slat D extends longitudinally along a predetermined direction D1.

Again with reference in particular to FIGS. 1 and 2, the elastic element 2 comprises a central body 21, a plurality of flexible arms 22 extending at an angle in a cantilever fashion from the central body 21 and a raised perimeter portion 23 connected to the flexible arms 22 and supported elastically by them.

In particular, the above-mentioned and not illustrated mattress rests in use on the raised perimeter portion 23.

Figure 10:
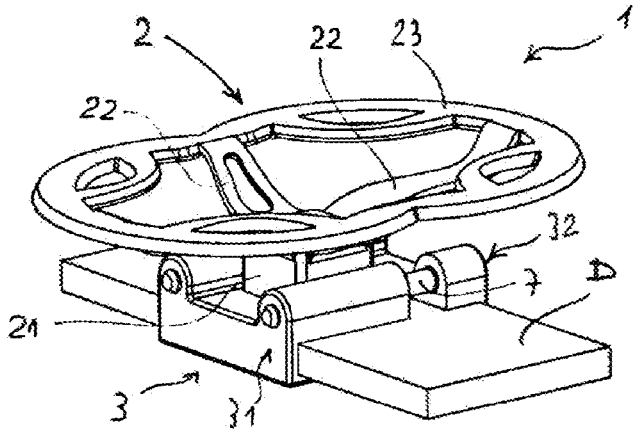
FIG. 10 is a schematic perspective view of an embodiment of the suspension of FIG. 1.

As clearly illustrated in FIGS. 1, 2 and 10, the supporting member 3 of the elastic element 2 is designed to be mounted on a slat D.

According to the embodiment of the suspension 1 illustrated in FIGS. 1 to 12, the supporting member 3 comprises two 31, 32 for engaging with the slat D and each of the engagement elements 31, 32 has a respective U-shaped open profile P.

The above-mentioned U-shaped profile P is configured to be inserted with partial superposing of the slat D, as clearly illustrated in FIGS. 2 and 10.

The supporting member 3 has an upright 4 emerging vertically from one 31 of its engagement elements 31, 32.

Figure 5:
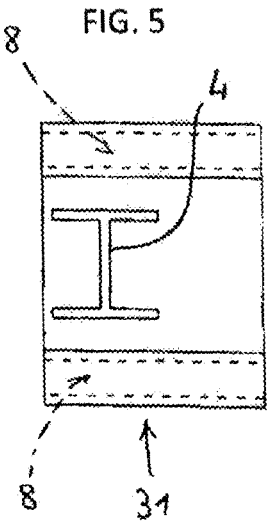
Figure 6:
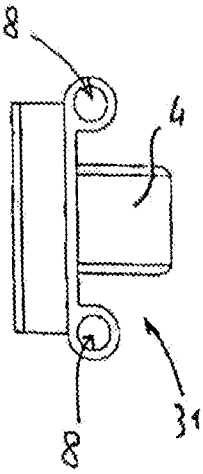

More in detail, as clearly illustrated in FIG. 5, the above-mentioned upright 4 has a square cross-section in the shape of an "H".

The elastic element 2 has a cavity C, made in its central body 21, the cavity C being designed to be inserted stably from above on the above-mentioned upright 4 of the supporting member 3.

Advantageously, the above-mentioned cavity C has a square cross-section configured to be inserted on the above-mentioned upright 4 of the supporting member 3, which also has a square cross-section, according to two configurations normal to each other.

In other words, due to the fact that the elastic element 2 extends mainly in a direction, by means of the square coupling it is possible for the user to orient the direction of extension according to two different configurations, at right angles to each other.

The H-shaped horizontal cross section of the upright 4, advantageously chosen also to simplify injection moulding, therefore makes it possible to choose, case by case and between two alternatives, the most suitable arrangement with which to position each active suspension, having at the top a horizontal oblong shape and two different transversal dimensions, which can be used as required.

Figure 16:
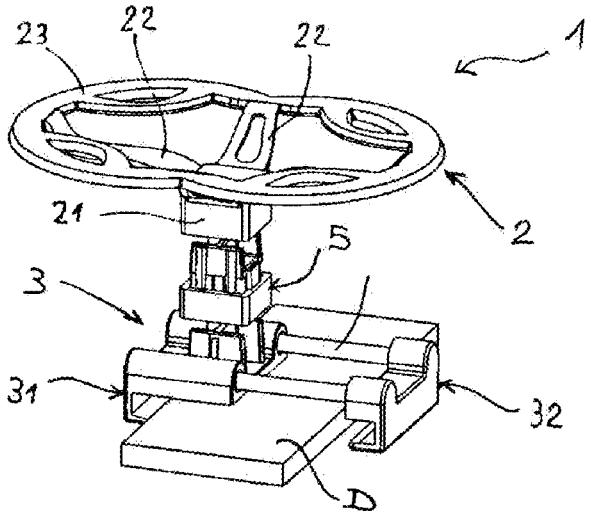
FIGS. 16 and 17 are exploded perspective views of the suspension of FIGS. 10 and 11 in two different configurations of use, respectively.
Figure 17:
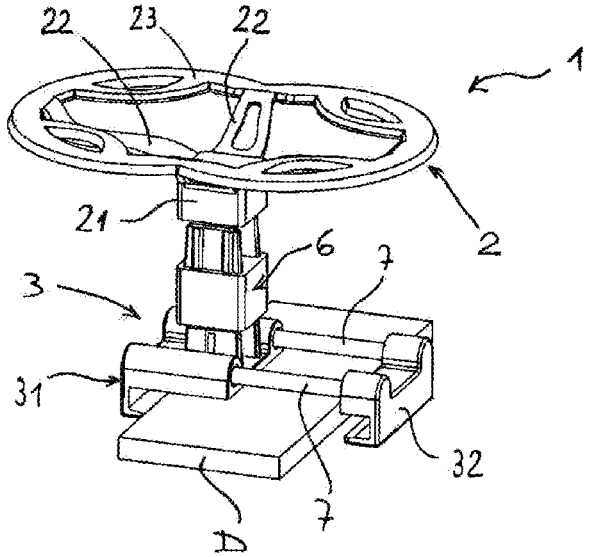

With reference to FIGS. 16 and 17, the active suspension according to the invention advantageously comprises spacer elements 5, 6 of different heights, designed to be interposed between the elastic element 2 and the upright 4 of the supporting member 3.

Obviously, each spacer element 5, 6 has a lower portion which replicates the cavity C of the elastic element 2 and an upper portion which replicates the upright 4 of the supporting member 3.

As illustrated in FIGS. 4 to 12, the supporting member 3 comprises two elements 31, 32 both having, as mentioned, a U-shaped profile P for being able to fork onto two opposite longitudinal edges of the slat D.

As illustrated in FIGS. 3 to 12, one 32 of the engagement elements has a pair of pins 7 and the other 31 of the engagement elements has two respective cavities 8 for housing the pins 7.

The above-mentioned pins 7 and cavity 8 are designed to define respective male-female couplings to keep stably connected the engagement elements 31, 32 around the slat D.

This coupling advantageously allows the use of the same engagement elements 31, 32 for clamping slats D even with different widths and in any case all the versions currently normally used in bed bases.

Moreover, the partial and temporary withdrawal of the pins 7 from the respective housing cavities 8 is sufficient to be able to modify the position of each active suspension 1 along the same slat D and adapt it to the requirements at the time, simply by making it slide longitudinally along the slat D.

Figure 8:
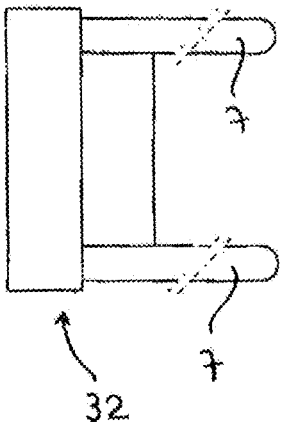
Figure 11:
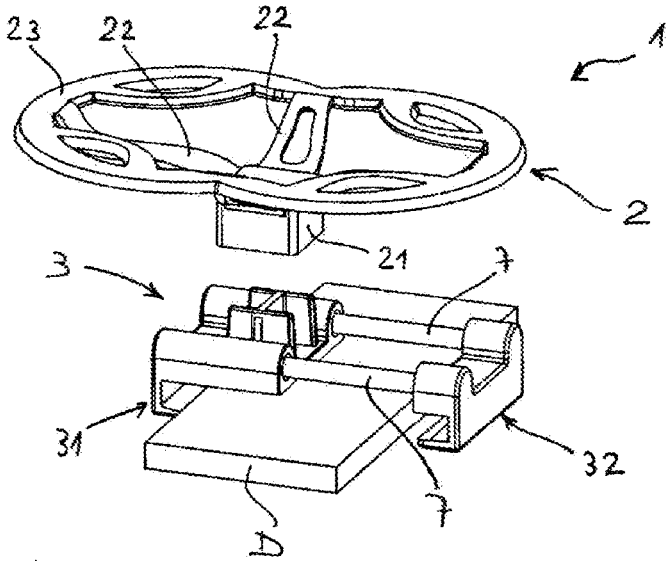
FIG. 11 is an exploded perspective view of the suspension of FIG. 10.
Figure 12:
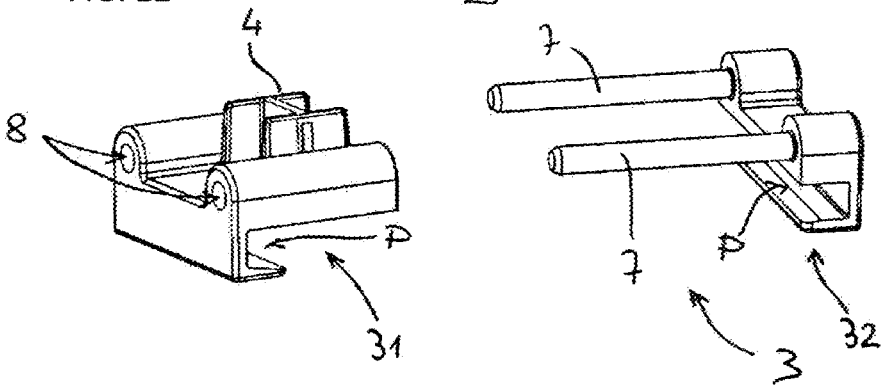
FIG. 12 is a schematic perspective view of two components of the suspension of FIGS. 10 and 11.

Advantageously, in order to make the coupling between the two engagement elements 31, 32 more stable, the pins 7 as illustrated in FIGS. 8, 11 and 12 are not made perfectly parallel to each other in such a way that their simultaneous insertion in the respective parallel cavities 8 determines a deformation with consequent tensioning of the pins 7, such as to force the two engagement elements 31, 32 to remain coupled to each other.

Similarly, the pins 7 may have a plurality of circumferential grooves designed to increase the friction with the respective housing cavities 8, again with the aim of keeping the two engagement elements 31, 32 stably coupled to each other.

According to variant embodiments not illustrated, the above-mentioned pins 7, if they comprise metallic inserts incorporated in the element C during the injection moulding of plastic materials, may be threaded at the end intended to protrude from the housing cavity 8 and on the end of which to screw a suitable lock nut of the engagement elements 31 and 32 coupled to each other.

Figure 13:
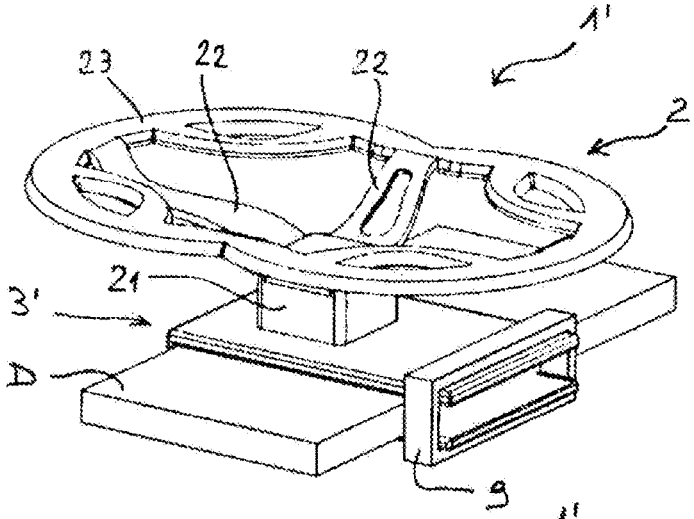
FIG. 13 is a schematic perspective view of a variant embodiment of the active suspension according to the invention.
Figure 14:
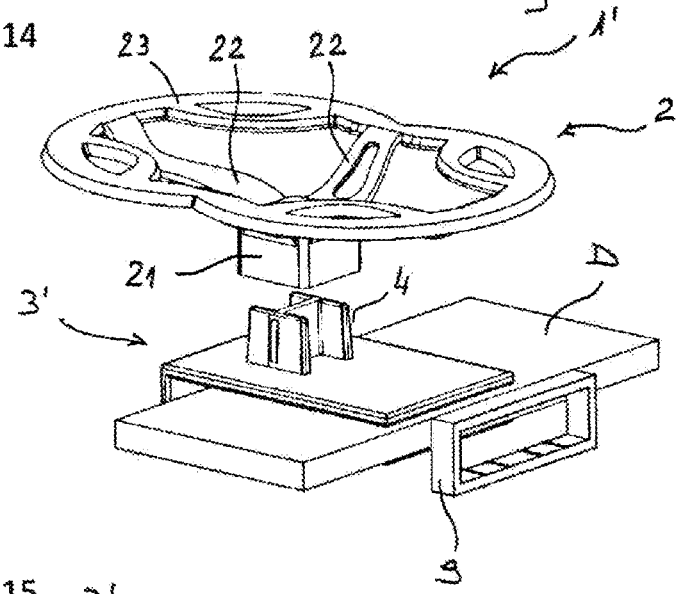
FIG. 14 is an exploded perspective view of the suspension of FIG. 13.
Figure 15:
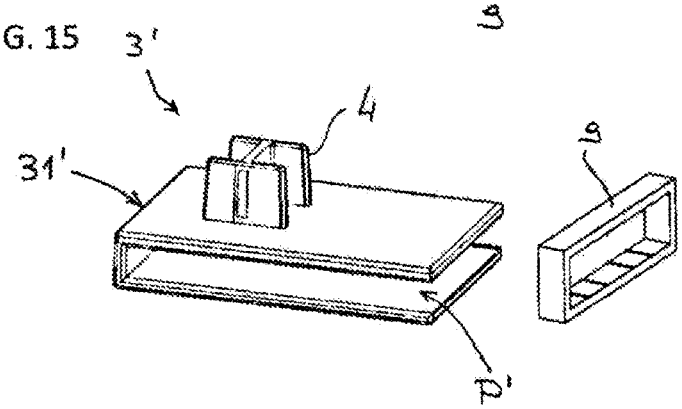
FIG. 15 is a schematic perspective view of two components of the suspension of FIGS. 13 and 14.

FIGS. 13 to 15 illustrate an alternative embodiment, labelled 1', of the improved active suspension device according to the invention.

The active suspension 1' differs from the active suspension 1 of FIGS. 1 to 12, basically due to the shape of the respective supporting member of the elastic element 2, denoted therefore by the reference numeral 3'.

The remaining parts of the active suspension 1' do not differ in substance from those of the active suspension 1 just described above, to which reference is therefore made.

As illustrated in FIGS. 13 to 15, the supporting member 3' has a single element 31' for engaging with the slat D.

The engagement element 31' has a respective open profile P' in the shape of a "U" which extends for a stretch greater than the width of the slat D, to be inserted substantially superposed on the slat D.

The active suspension 1' therefore comprises an element 9 for clamping the above-mentioned open profile P' shaped in the form of a "U" of the engagement element 31', the clamping element 9 configured to keep the engagement element 31' stably in contact with the slat D, engaging in the clamping of the ends of the engagement element 31' emerging in a cantilever fashion from the slat D.

As illustrated in detail in FIG. 15, the clamping element 9 is of an annular type with a quadrangular shape.

Advantageously, the clamping element 9 has, on its inner surface intended to enter into contact with the engagement element 31', projections designed to improve the gripping with the engagement element.

According to alternative embodiments not illustrated, the clamping element comprises an annular elastic designed to wrap around the ends of the engagement element 31' emerging in a cantilever fashion from the slat D.

The active suspension 1, 1' according to the invention achieves the preset aims and brings important advantages.

A first advantage connected to the adoption of the improved active suspension device according to the invention is due to the fact that its application, removal or even its mere movement do not require tools or the removal of the slat for the relative sliding out.

Yet another advantage linked to the invention is due to the possibility of adapting the distance from the slat of the supporting portion of the mattress by adopting suitable spacer elements, which are easy and practical to insert.

The invention claimed is:

1. An active suspension for giving an additional spring to an overlying mattress, said active suspension comprising:

an elastic element comprising a central body, a plurality of flexible arms extending in a cantilever fashion from the central body and a raised perimeter portion connected to said flexible arms and supported elastically by said flexible arms, a supporting member for supporting the elastic element, configured to be mounted on a slat, said supporting member having two engagement elements for engaging with said slat, both of the engagement elements having a respective U-shaped open profile, both of the U-shaped open profiles being configured to be inserted to least partially superpose said slat at opposite longitudinal edges of the slat, wherein one of the engagement elements has at least one pin and the other of the engagement elements has at least one cavity for housing said at least one pin, said at least one pin and at least one cavity being configured to define a male-female coupling to keep stably connected said engagement elements around said slat.

2. The suspension according to claim 1, wherein said at least one cavity is a through cavity, wherein said at least one pin is threaded at a distal end protruding from the at least one cavity to threadingly engage a nut for clamping the engagement elements to each other.

3. The suspension according to claim 1, wherein the supporting member includes an upright emerging vertically from a relative one of the engagement elements, wherein said relative one of the engagement elements includes an upright cavity, made in said relative central body, configured to be inserted stably from above on said upright of the supporting member.

4. The suspension according to claim 3, wherein said upright cavity has a square cross-section configured to be inserted on the upright of the supporting member according to two configurations normal to each other.

5. The suspension according to claim 3, and further comprising a spacer element interposed between said elastic element and the upright of the supporting member.

* * * * *